United States Patent [19]

Sasaki et al.

[11] Patent Number: 4,668,849

[45] Date of Patent: May 26, 1987

[54] DETENT MECHANISM FOR SLIDING ELECTRIC PARTS

[75] Inventors: Shinji Sasaki, Miyagi; Yujiro Shimoyama; Yoshinori Watanabe, both of Furukawa, all of Japan

[73] Assignee: Alps Electric Co., Ltd., Japan

[21] Appl. No.: 779,150

[22] Filed: Sep. 23, 1985

[30] Foreign Application Priority Data

Sep. 21, 1984 [JP] Japan ..... 59-143135[U]

[51] Int. Cl.[4] ..... H01H 15/10

[52] U.S. Cl. ..... 200/291; 200/16 C

[58] Field of Search ..... 200/291, 277, 16 C, 200/16 D

[56] References Cited

U.S. PATENT DOCUMENTS 2,135,809 11/1938 Fruth ..... 200/277
3,745,270 7/1973 Granitz ..... 200/16 C
4,152,565 5/1979 Rose ..... 200/291
4,316,067 2/1982 Whiteman, Jr. ..... 200/291
4,417,107 11/1983 Terajima ..... 200/16 C

FOREIGN PATENT DOCUMENTS 763245 12/1956 United Kingdom ..... 200/277
1018357 1/1966 United Kingdom ..... 200/291

*Primary Examiner*—Stephen Marcos
*Assistant Examiner*—Renee S. Luebke
*Attorney, Agent, or Firm*—Guy W. Shoup

[57] ABSTRACT

Disclosed is a detent mechanism for use in a control with a sliding lever, in which the lever is slid to desired operation positions, such as for example, a slide switch or a volume control of a radio. In the detent mechanism, a slide guide is formed with a series of cam crests. Fixed to the sliding lever is a spring member which carries a roller at its leading end which engages with and rolls on the cam crests.

6 Claims, 6 Drawing Figures

DETENT MECHANISM FOR SLIDING ELECTRIC PARTS

BACKGROUND OF THE INVENTION

1. Field of the Invention

The present invention relates to a sliding electric part, in which an operation lever protrudes to the outside from a casing and is slid for operations, such as a slide switch or a volume control for audio equipment and, more particularly, to a detent mechanism for use with the sliding electric part.

2. Description of the Prior Art

Taking the slide switch as an example, the detent mechanism shown in FIG. 6 is known in the prior art. As shown in FIG. 6, more specifically, reference numeral 1 indicates a casing, and numeral 2 indicates a slider which is cased in the casing 1 and which is formed integrally with an operating lever 3 protruding to the outside from the casing 1. That slider 2 is formed with a vertically through hole 4, in which are fitted a coil spring 5 and ball 6 biased at all times outward by the action of the coil spring 5.

The casing 1 is formed with click holes 7 and 7 in positions corresponding to the through hole 4 of the slider 2. As the slider 2 slides, the balls 6 and 6 are brought into engagement with those click holes 7 and 7 by the biasing force of the coil spring 5, thus constructing a detent mechanism.

In FIG. 6, incidentally, numerals 8 and 8 indicate contacts, and numeral 9 indicates a wafer which is equipped with terminals 9*a*.

The detent mechanism of the sliding electric part of the prior art has the construction described above. This construction is always formed to include between the casing 1 and the slider 2 the clearances $\alpha$ and $\beta$, which allow the slider 2 to slide in the casing 1.

However, the presence of those clearances $\alpha$ and $\beta$ produces looseness during operation, and therefore the detent mechanism of the prior art has defects that it has a bad operating feeling and that the operation lever sometimes overruns the target position.

SUMMARY OF THE INVENTION

It is, therefore, an object of the present invention to provide a detent mechanism for a sliding electric part, which is free from the above-specified defects of the prior art.

Another object of the present invention is to provide an improved detent mechanism of the above type, which has no looseness so as to offer not only an improved operating feeling by generating a negative load immediately before the lever shifts to a subsequent position but also a positive targetting effect which positions the slider in its intended position without failure.

In order to achieve these objects, the detent mechanism according to the present invention is characterized in that a slide guide formed in a casing has a series of cam crests, and in that there is fixed to an operation lever a spring member carrying a roller at its leading end which engages with and rolls on the cam crests.

According to a major feature of the present invention, in a sliding electric part including: a casing having a slit; and an operation lever inserted in the slit of said casing and protruding therefrom to the outside, there is provided a detent mechanism comprising: a slide guide formed in said casing and having a series of cam crests for guiding the sliding movements of said operation lever; a spring member fixed to said operation lever; and a roller carried on the leading end of said spring member and adapted to engage with and roll on the cam crests of said slide guide.

BRIEF DESCRIPTION OF THE DRAWINGS

Other objects, features and advantages of the present invention will become more apparent from the following description taken in connection with one embodiment thereof with reference to the accompanying drawings, in which.

DESCRIPTION OF THE PREFERRED EMBODIMENT

Figure 1:
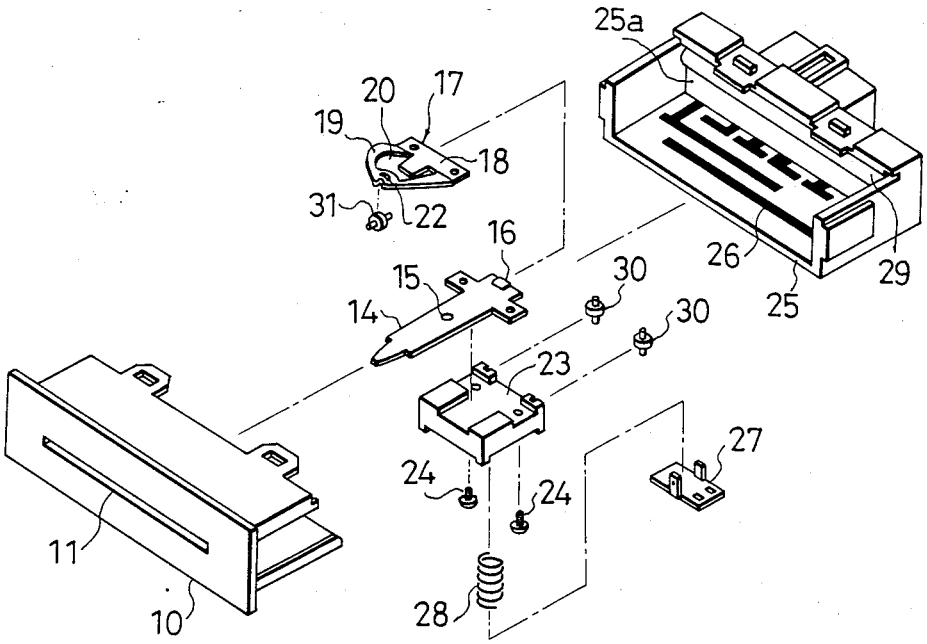
FIG. 1 is an exploded perspective view showing a slide switch equipped with a detent mechanism according to the present invention.
Figure 2:
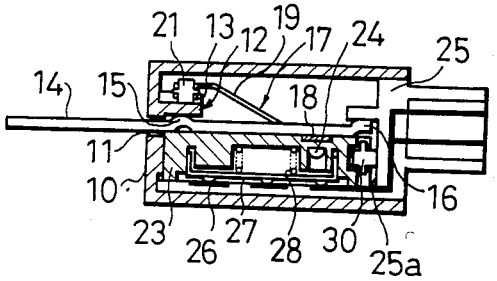
FIG. 2 is a longitudinal section showing the slide switch.

The present invention will be described in the following in connection with one embodiment thereof with reference to FIGS. 1 to 5.

Indicated at reference numeral 10 is a casing which is formed with its front plate having a slit 11 in which is inserted the leading end of a later-described operation lever. The casing 10 is also formed integrally with a slide guide 12 for sliding the operation lever, which is located at the back of the front plate of the casing and slightly above the slit 11. The slide guide 12 has formed on its upper face a series of cam crests 13.

The operation lever, which is now indicated at numeral 14, is so inserted in the slit 11 of the casing 10 as to protrude to the outside. The operation lever 14 is formed at its generally central portion with an upward protrusion 15, which is to come into abutment against the lower face of the slide guide 12 of the casing 10, and its rear end with an upward protrusion 16 which is to come into abutment against the lower face of the slide guide of a later-described circuit board.

On the operation lever 14 thus constructed, there is fixed a leaf spring member 17 which is constructed of a body 18 and an operating portion 19 bent forward and upward from the body 18. The operating portion 19 is formed generally at its center with an inserting hole 20, in which is inserted the operating lever 14, and at its protruding end with a roller retaining portion 22 which retains and carries such a roller 21 as to engage with and roll on the cam crests of the slide guide 12 of the casing 10. More specifically, the roller 21 is so supported by its retaining portion 22 that it can roll freely while being biased into a forced state.

Indicated at numeral 23 is a slider in which is fitted the lower face of the operation lever 14. Moreover, this operation lever 14 and the aforementioned leaf spring member 17 are fastened together through the slider 23 by means of screws 24 and 24 which are screwed into the lower face of the slider 23.

A contact 27 is fitted in the bottom of that slider 23 such that it is biased downward at all times by the action of a coil spring 28. The contact 27 is in sliding contact with a contacting portion 26 which is printed on a circuit board 25. This circuit board 25 is assembled with the casing 10.

Incidentally, the circuit board 25 is formed with the rear slide guide which is now indicated at numeral 29. The aforementioned protrusion 16 of the operation lever 14 is in abutment against with the lower face of that slide guide 29.

To the rear end face of the slider 23, moreover, there are attached a pair of rollers 30 and 30 which are in rolling contact with the inner face 25*a* of the upright wall of the circuit board 25 to smoothen the sliding movements of the slider 23.

Figure 3:
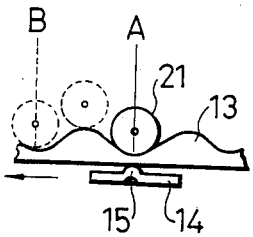
FIG. 3 is a schematic front elevation for explaining the operations of the detent mechanism of the present invention.
Figure 4:
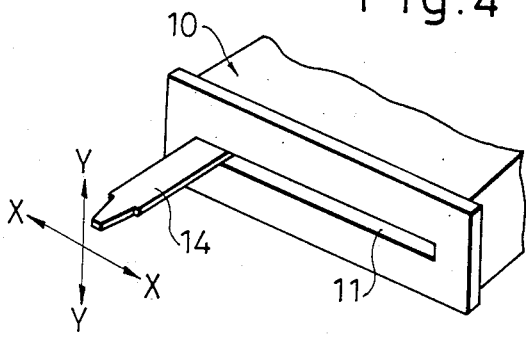
FIG. 4 is a perspective view showing a front panel of the slide switch.

Here, when the operation lever 14 is moved in the direction of the arrow, as shown in FIG. 3, the roller 21 which is carried on the protruding end of the leaf spring member 17 rolls on the cam crests 13 of the slide guide 12 from a point A to a point B. During these rolling motions, the upward protrusion 15 of the operation lever 14 is urged onto the lower face of the slide guide 12 at all times by the elastic force of the leaf spring member 17 so that no looseness is produced in the vertical directions, as indicated at Y—Y in FIG. 4. In the horizontal directions indicated at X—X, too, occurrence of the looseness is suppressed by the elastic, frictional forces which are generated between the roller 21 supported on the protruding end of the leaf spring member 17 and upward protrusion 15 of the operation lever 14 through the slide guide 12 and between the lower face of the rear slide guide 29 of the wafer 25 and the upward protrusion 16 of the operation lever 14.

Figure 5:
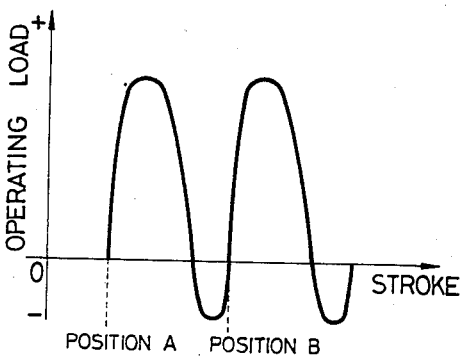
FIG. 5 is a graph showing a feeling curve of the same detent mechanism.
Figure 6:
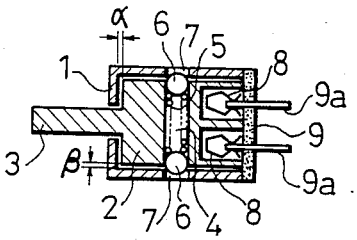
Fig. 6 PRIOR ART
FIG. 6 is a longitudinal section showing an example of the prior art.

FIG. 5 is a graph showing the feel of a slide switch according to the present embodiment when it is used. In this graph, the operating load is plotted against the stroke of the operation lever 14.

With reference to the graph shown in FIG. 5, it is understood that the roller 21 can roll sufficiently snugly to move from the point A to the point B, as shown in FIG. 3. It is also understood that a minus load is also established to improve the snug rolling better as a result that the roller 21 is in rolling contact with the descending portion of cam crest 13 immediately before it reaches the point B and is in rolling contact with the two cam crests 13 when it reaches the desired position.

Although the present embodiment has been described by taking the slide switch as an example, the present invention should not be limited thereto but can naturally be applied to and practised by all sliding electric parts such as the volume control of an audio system.

As has been described, according to the present invention, the detent mechanism of the sliding electric part can be made free of any looseness to enjoy such a good operating feeling as has a minus load generated immediately before a subsequent position. The detent mechanism of the present invention can also bc freed from any run over the targeted positioning, as is different from the prior art, so that it can perform accurate operations.

What is claimed is:

1. In a detent mechanism for a sliding switch of the type having a casing, a guide slot in a front panel of said casing, a slide lever slidably mounted in said slot having one end portion extending from said casing and a contact end portion disposed toward the rear portion of said casing, and detent means for linearly guiding said slide lever in a plurality of detent positions across said slot, the improvement wherein said detent means comprises a slide guide formed as a linear wall on a rear side of said front panel of said casing extending parallel to said slot, said slide guide having a detent surface extending parallel to the direction of said slide lever and formed with a series of cam crests thereon, said slide lever having a spring member with one end fixed to an intermediate portion of said slide lever and its other end mounting a roller biasingly engaged in rolling contact with said cam crests of said detent surface of said slide guide, and wherein said slide guide is formed as a thin planar wall having said detent surface on one side and a slide surface on the other side thereof, said slide lever has a protrusion intermediate its ends disposed in abutting sliding contact with said slide surface of said slide guide, and said slide guide is held in sliding and rolling contact between said slide lever protrusion and said roller mounted on said spring member.

2. In a detent mechanism for a sliding switch of the type having a casing, a guide slot in a front panel of said casing, a slide lever slidably mounted in said slot having one end portion extending from said casing and a contact end portion disposed toward the rear portion of said casing, and detent means for linearly guiding said slide lever in a plurality of detent positions across said slot, the improvement wherein said detent means comprises a slide guide formed as a linear wall on a rear side of said front panel of said casing extending parallel to said slot, said slide guide having a detent surface extending parallel to the direction of said slide lever and formed with a series of cam crests thereon, said slide lever having a spring member with one end fixed to an intermediate portion of said slide lever and its other end mounting a roller biasingly engaged in rolling contact with said cam crests of said detent surface of said slide guide, and wherein said slide guide is disposed on an upper side of said slot, said detent surface is an upper surface of said slide guide, and a lower surface of said slide guide on the opposite said from said detent surface is a planar guide wall defining said upper side of said slot.

3. A detent mechanism according to claim 2, wherein said slide lever has a protrusion intermediate its ends disposed in abutting sliding contact with said lower surface of said slide guide.

4. A detent mechanism according to claim 3, wherein said casing has a second slide guide disposed on a rear wall thereof, and said slide lever has a second protrusion on its contact end portion disposed in abutting sliding contact with a lower surface of said second slide guide.

5. In a detent mechanism for a sliding switch of the type having a casing, a guide slot in a front panel of said casing, a slide lever slidably mounted in said slot having one end portion extending from said casing and a contact end portion disposed toward the rear portion of said casing, and detent means for linearly guiding said slide lever in a plurality of detent positions across said slot, the improvement wherein said detent means comprises a slide guide formed as a linear wall on a rear side of said front panel of said casing extending parallel to said slot, said slide guide having a detent surface extending parallel to the direction of said slide lever and formed with a series of cam crests thereon, said slide lever having a spring member with one end fixed to an intermediate portion of said slide lever and its other end mounting a roller biasingly engaged in rolling contact with said cam crests of said detent surface of slide guide, and wherein said spring member comprises a body portion having mounting holes for mounting said spring member to corresponding mounting holes formed in said slide lever, and a resilient working portion bent upwardly from said body portion so as to extend over said detent surface of said slide guide.

6. A detent mechanism according to claim 5, wherein said body portion of said spring member is disposed toward said rearward contact end portion of said slide lever and said working portion extends upwardly and frontwardly toward said front panel of said casing.

* * * * *